US008172707B2

(12) United States Patent
Cox

(10) Patent No.: US 8,172,707 B2
(45) Date of Patent: May 8, 2012

(54) NET HOLDING STANDARD USING BASKETBALL RIM

(76) Inventor: Paul J. Cox, Eagle, ID (US)

( * ) Notice: Subject to any disclaimer, the term of this patent is extended or adjusted under 35 U.S.C. 154(b) by 44 days.

(21) Appl. No.: 12/827,950

(22) Filed: Jun. 30, 2010

(65) Prior Publication Data

US 2012/0004056 A1 Jan. 5, 2012

(51) Int. Cl.
*A63B 67/00* (2006.01)

(52) U.S. Cl. ..... 473/492; 473/473; 473/416

(58) Field of Classification Search ..... 473/473, 473/474, 476, 479, 485, 487, 492–494, 416
See application file for complete search history.

(56) References Cited

U.S. PATENT DOCUMENTS 3,602,504 A * 8/1971 Chapman et al. ..... 473/416
4,307,887 A 12/1981 Weiss
4,786,053 A * 11/1988 Barnes, Jr. ..... 473/416
5,072,947 A 12/1991 Blue
5,393,069 A 2/1995 Taylor
5,575,481 A 11/1996 Lovetere
5,792,014 A 8/1998 Brown
6,776,733 B2 * 8/2004 Schroeder ..... 473/473
7,001,291 B2 * 2/2006 Carey ..... 473/481
2004/0214665 A1 * 10/2004 Kane et al. ..... 473/433
2005/0059514 A1 * 3/2005 Carey ..... 473/492

OTHER PUBLICATIONS

Pool Basketball-Volleyball Net Combo: http://www.bestbuypoolsupply.com/games-toys.htm. Accessed on Jul. 29, 2010.

* cited by examiner

*Primary Examiner* — Raleigh W. Chiu

(74) *Attorney, Agent, or Firm* — Robert L. Shaver; Dykas & Shaver, LLP

(57) ABSTRACT

A net standard for attachment to basketball rims to which nets of games such as volleyball or badminton can be attached.

29 Claims, 6 Drawing Sheets

NET HOLDING STANDARD USING BASKETBALL RIM

FIELD OF THE INVENTION

The invention generally relates to standards for holding nets, and in particular, net holding standards which are attached to the rim of a basketball goal.

BACKGROUND OF THE INVENTION

The majority of elementary schools, junior high schools, high schools, colleges and recreation centers have a gymnasium in which is located one or a number of basketball goals. The basketball goals include a backboard and the rim through which the basketball passes. Many gyms have goals, not only at each end of a basketball court, but in multiple positions along the side of a basketball court. Thus, a full court basketball game can be played, and during physical education classes or at other times, the basketball goals at the sides of the basketball court can provide more locations for basketball to be played.

In these school gymnasiums, other sports are played besides basketball. These might be part of physical education classes, or they might be classes taught by the school; they could be intramural games, or other situations that might require nets to be placed on the floor of the basketball court. Some of these net games might include volleyball, badminton, pickle ball, and other games which require a net to be erected.

The present method of erecting nets for net sports on the gymnasium floor involves standards which are inserted into sleeves in the floor or, portable standards placed on the floor of the basketball court. These portable standards typically have a large base which sits on the floor and which has a good deal of weight in the base to prevent tipping over of the net standard. Attached to the base is a long pole which extends up off of the gymnasium floor to the height required for a particular net based game. The net is attached to the standard by various means, such as holes in the pole, or by loops or other tie off points at which the corners of the net are attached. The standards, with their attached counterweight, can have wheels and may be tippable onto the wheels so that they can be moved on or off the court and into storage.

Since two standards are required for every net game, storage of the standards can be quite bulky, and setting up and tearing down nets and their standards can be time consuming and laborious.

Another problem with the net standards of the prior art is that the net standards may be pulled over by players of the game, and once a net standard has passed the tipping point, it may fall down and strike a player with resultant injuries.

What is needed is a net standard which is easily assembled, which eliminates the possibility of tipping over on a player, which is less expensive than the existing standards, and one which is stored more compactly than existing net standard bases.

SUMMARY OF THE INVENTION

The net holding standard of the invention is a device which attaches to a standard basketball rim and which has a generally pole shaped net standard attached to a rim attachment plate which adjusts downward from the basketball rim. Nets of various games can be attached to the net standard by strings, straps, or cables attached to the corners, sides, and ends of the net. In this way, a volleyball net, badminton net, pickle ball net, or other nets for games may be attached to the net standard of the invention with the net standard attached to a basketball rim.

The net holding standard of the invention includes a rim attachment plate which has a top side and a bottom side. The rim attachment plate can take a number of different configurations. It can be a circular plate, or it can have a left and a right side that are parallel to each other, with the first end and a second end being a curved or arcuate shape. The rim attachment plate attaches to the basketball rim. The rim attachment plate has a rim retaining groove which is an arcuate track which is consistent with the curve of a basketball rim, and which is made for interfitting engagement with the basketball rim. The second end of the rim attachment plate also engages the basketball rim. It may do so with a sliding plate with a spring, in which the spring pulls the sliding plate toward the end of the rim attachment plate, and in which the sliding plate overlaps the basketball rim and secures the rim attachment plate to the basketball rim.

To the rim attachment plate is attached an adjustable net standard, which is generally a pole-like device which extends downwardly from the rim attachment plate towards the floor of the gymnasium. The device can include a sleeve which is mounted in the rim attachment plate and through which the net standard is secured. In a version with the sleeve enclosing the net standard, the net standard could move up and down in the sleeve for positioning purposes. The net standard can be a square tube, a round tube, or other shapes of tubes, or it can be a solid structure. A tubular structure is preferred, due to the reduced weight involved. The net holding standard can be of various lengths and can be adjustable in length. The advantage of a net holding standard which is longer is that there is less possibility of a user hitting the bottom of the net standard with his head. The net standard can also be just the length required for the attachment of the net of a particular game, so that people can walk under the net standard without the risk of bumping into it. The net standard can also be extended so that it extends all the way to the floor surface of the playing field, and it may be securable to the floor.

The net standard assembly of the invention can also include a detachable net attachment bracket. When a net is attached directly to the net standard, if a player runs into a net while playing or falls into the net, significant sideways force can be applied to the net standard. This sideways force is transmitted to the net standard and rim, and could potentially break or bend the net standard itself. By having a detachable net attachment bracket, the net for the sport is attached to the detachable bracket. When someone falls or runs into the net, the force of their impact with the net will present a sideways pulling force against the net attachment bracket, and it will overcome the attachment force of the net attachment bracket to the net standard, and the net attachment bracket will pull off of the net standard. This will prevent that force from being applied to the rim attachment plate or to the net standard itself. The detachable net attachment bracket can be one bracket in the form of a bar which snaps into place in an upper and lower bracket to hold it to the net standard. It can also be two or more points of attachment such as an upper and lower bracket, each of which can be pulled off of their attachment to the net standard. The detachable net attachment bracket and the upper and lower bracket can attach to the net standard in a variety of different mechanical connections including a snap fit which may be overcome by the force of the sideways pull, hook and loop fabric connections which are sized to make them easily removable from the net standard, by magnets, or by other common mechanical means. The net standard may also have attachment points to which the sports net can be attached, with releases built into the lines of the net. These can be releasable magnets, hook and loop (Velcro), or mechanical means of release.

Where a top and bottom bracket are utilized to secure the net attachment bracket to the net standard, the top and bottom bracket may be adjustable in position on the net standard, and may include a first and second bracket clamp for securing the brackets to the net standard.

The rim attachment plate includes a first and second rim engaging bracket, with the rim engaging bracket configured to engage opposite sides of the basketball rim. The rim engaging brackets can take a number of forms, and may be two brackets at opposite ends of the rim attachment plate, or they may be three or more brackets which engage the basketball rim. The rim attachment plate also includes a rim clamp for securing the rim attachment plate to the basketball rim. The rim clamp can take a number of forms, and would typically press against the inside of the basketball rim. However, configurations in which the rim clamp press against the outside of the basketball rim at multiple points are also envisioned and to be considered part of the concept of the invention. The rim engaging brackets can take several different forms including a curved wall which is consistent with the curve of the basketball rim and which would help secure the rim attachment plate to the basketball rim. A number of vertical posts could also achieve attachment of the rim engagement plate to the basketball rim. One version of the device has a first and second arcuate rim engagement wall, which are consistent with the curved basketball rim and attached to the bottom side of the rim engagement plate. Besides the first and second arcuate rim engagement wall, the rim engaging bracket can take the form of a first and second rim retaining groove, with the groove forming a curved structure for engagement with the basketball rim.

The net holding standard can also have an attached collision prevention structure which can take a number of different forms. For instance, it could be a resilient ball-shaped structure such as a ball of foam which would cushion the end of the net standard so that if someone struck the end of the net standard with their head, they would not be injured. Similarly, the length of the net standard can also be covered with a padded layer to minimize the risk of injury from a player striking the net standard.

The net standard can include a joint near its attachment to the rim attachment plate, sleeve, or basketball rim. The joint could be dislocatable, to release before significant force is applied to the basketball rim or rim attachment plate. The joint could be magnetic, or a hinged joint which would allow the net standard to move before significant force was applied to the basketball rim or rim attachment plate.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
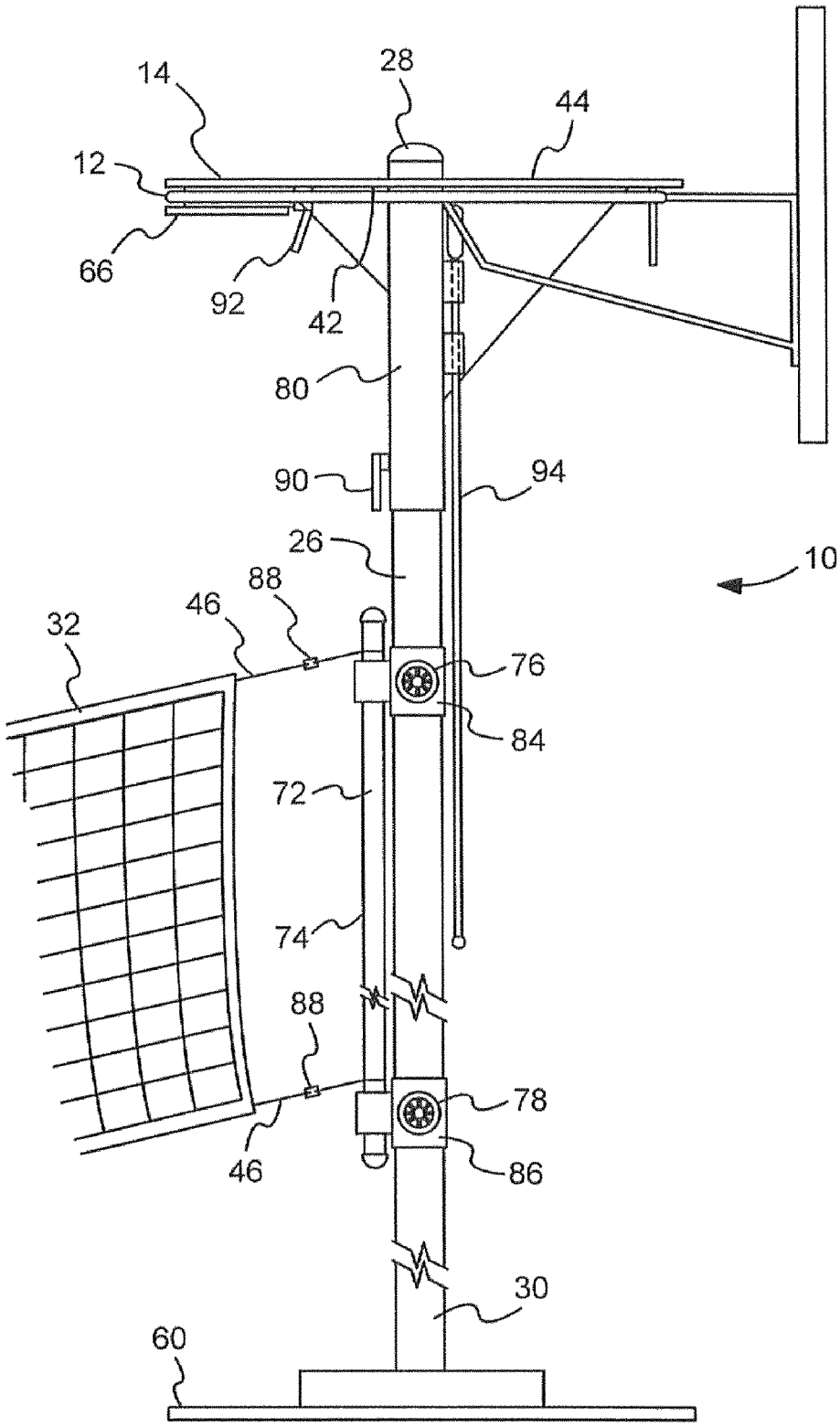
FIG. 1 is a side view of one version of net standard assembly of the invention attached to a basketball rim.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Shown in FIG. 1 is the net standard assembly 10 of the invention. It is attached to a basketball rim 12 and includes an attached net 32 suspended over a floor 60 on which a game involving a net may be played, such as badminton, volleyball, pickle ball, or other net sports. The net standard assembly 10 includes a rim attachment plate 14 which has a bottom side 42 and a top side 44. The net standard 26 has a first end 28 and a second end 30. A version of the net standard 26 may extend all the way to the floor 60 of the playing area, or it may extend down from the basketball rim 12 to a point above the floor 60. The net standard 26 would typically be encased in foam padding which acts as a collision prevention structure, and reduces the chance of injury by a player's collision with the net standard 26 of the invention. The net standard 26 could be made of steel, aluminum, fiberglass, plastic, carbon fiber, or any material with sufficient strength and durability for this purpose.

Attached to the net standard 26 is a detachable net attachment bracket 72. This can be in the form of a rod 74, or it can be in the form of individual attachment brackets for attachments of the upper and lower cords of the net 32. The detachable net attachment bracket 72 is attached to the net standard by a top bracket 76 and a bottom bracket 78. These preferably have a connection to the net attachment bracket which allows release of the net attachment bracket when sufficient sideways pressure is placed on the net. This could happen when a player runs into the net or falls into the net. At that time significant sideways pull may be placed on the net strings 46, which would transfer the sideways pull to the net standard 26. In that case the detachable net attachment bracket 72 would pop off from its attachment from the top bracket 76 and the bottom bracket 78, and release the net 32 from the net standard 26. This would prevent excessive force being applied to the net from being transmitted to the basketball rim 12, or vulnerable parts of the net standard 26.

The bottom bracket 76 and the top bracket 78 are shown with a first bracket clamp 84 and a second bracket clamp 86, which may be utilized to position the top and bottom brackets 76 and 78 at a desired height on the net standard 26.

The detachable net attachment bracket 72 is shown in FIG. 1 as being secured by a friction clamp, but other releasable methods of attaching the net attachment bracket to the net standard are also possible. This can include an attachment such as utilizing hook and loop fabric (Velcro), by the use of magnets, or by the use of a releasable connection 88 in the net strings 46.

Figure 6:
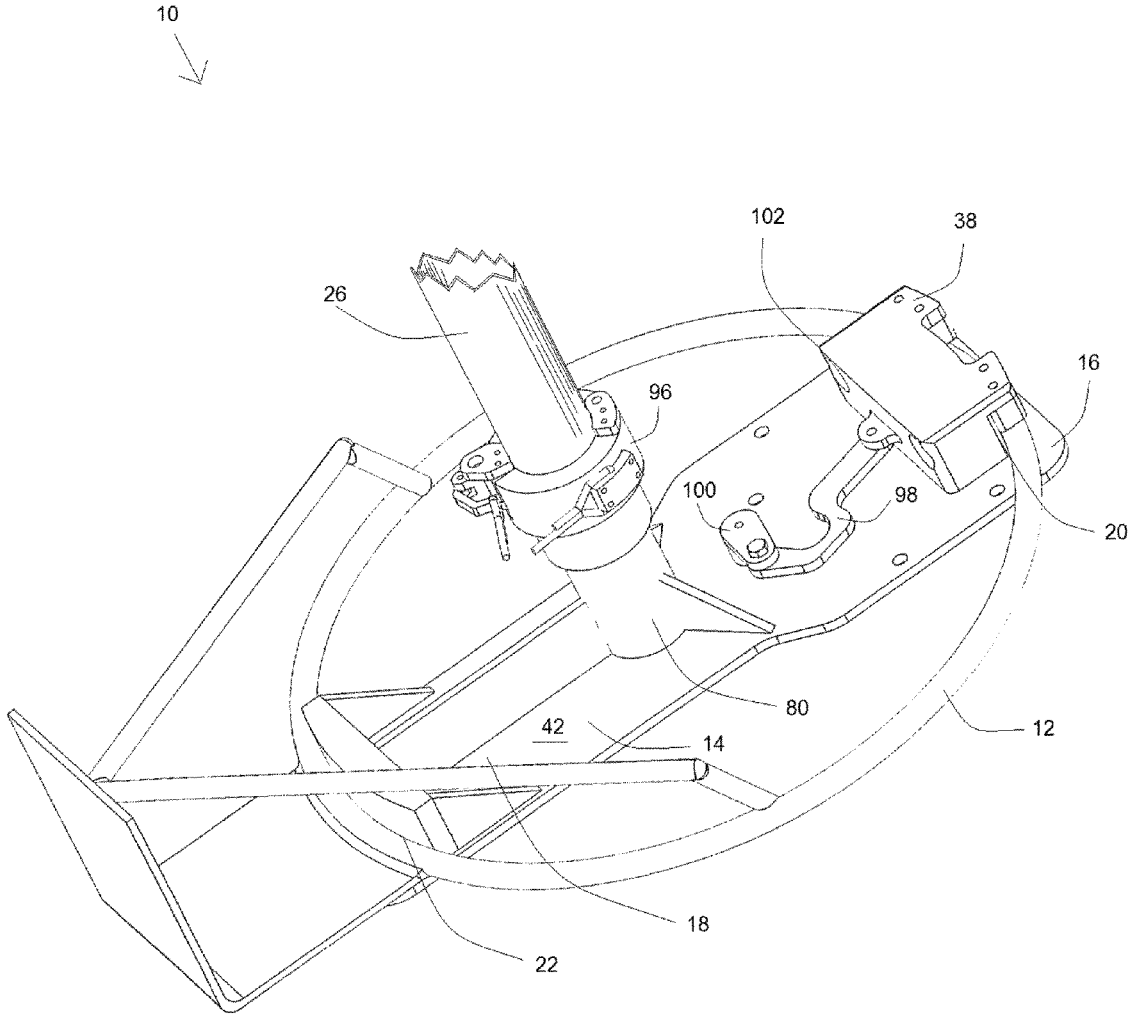
FIG. 6 is a perspective view of the bottom side of the rim attachment plate on a basketball rim.

In the embodiment shown in FIG. 1, the position of the net standard 26 is secured in the sleeve 80 by the use of a sleeve locking lever 90. A different preferred design is shown in FIG. 6 which utilizes a rotary locking device for both adjustment of the net standard and securing the device to the rim.

The rim clamp 66 which is attached to the rim attachment plate 14 may also be secured by a rim clamp lever 92. In this particular embodiment, an adjustment lever 94 has a releasable mounting point to the net standard 26. The adjustment lever 94 has an end which is configured to engage the levers 92 and 90, and assist in adjusting the rim clamp 66 and the position of the net standard 26. Similar to the use of the lever, the adjustment device can include a socket, alien wrench, or insert which engages a rotary based adjustment knob for adjusting the rim clamp 66 or the sleeve locking clamp 90.

Figure 2:
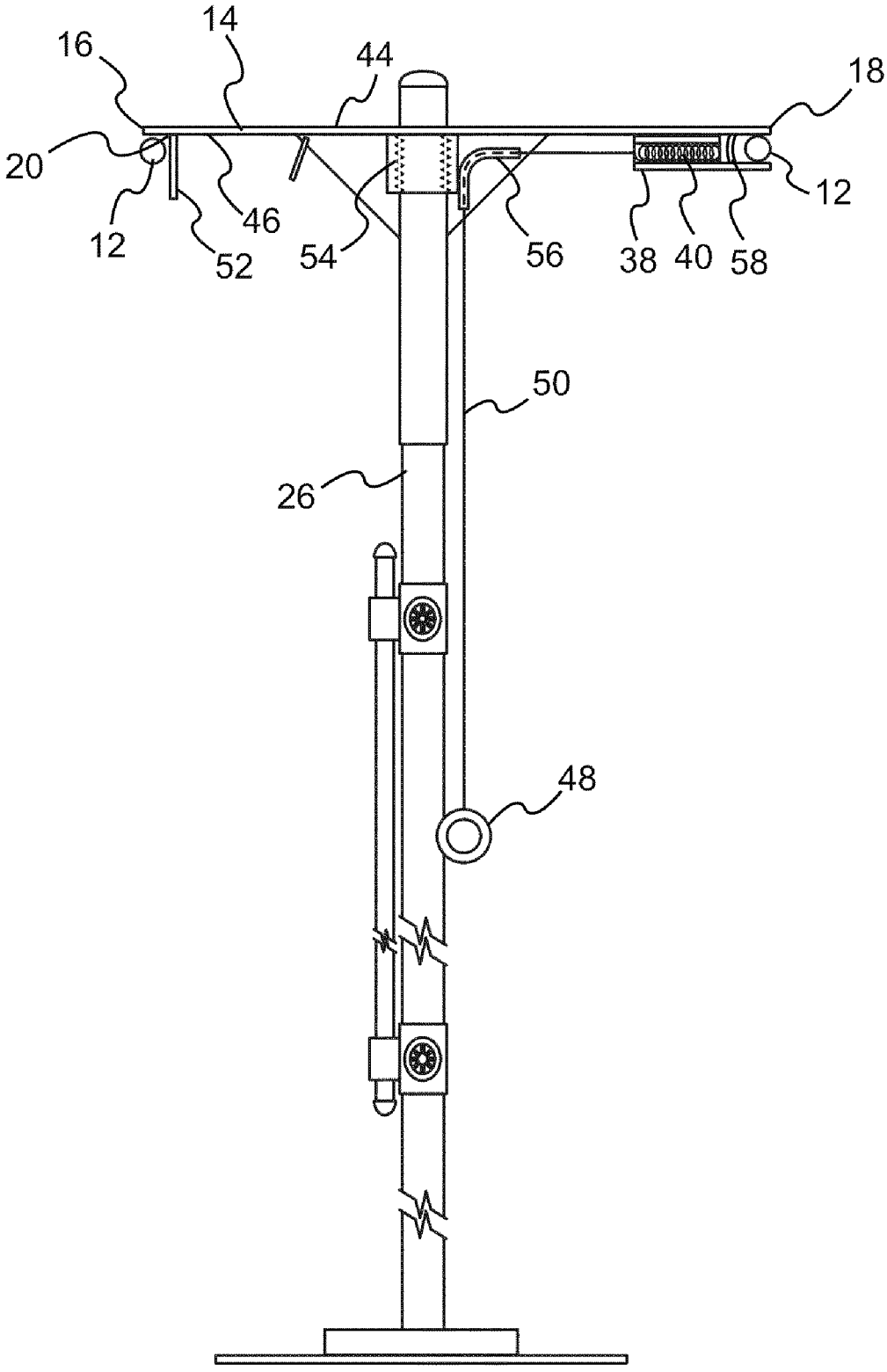
FIG. 2 is a side cross-sectional view of the net standard of the invention mounted on a basketball rim.

FIG. 2 is a side cross-sectional view of one version of the net standard assembly 10 of the invention mounted to a basketball rim 12. The net standard assembly 10 includes a rim attachment plate 14 which has a top side 44 a bottom side 42, a first end 16 and a second end 18. The rim attachment plate 14 is shown in the Figures as being generally rectangular with rounded ends. However the purpose of the rim attachment plate is to interlock with the basketball rim, so the rim attachment plate could also be rectangular with square corners, circular, square, ring shaped, or oval, each of which shape would work as long as the top side 44 of the rim attachment plate overlapped the edges of the basketball rim over at least at two points around its circumference. The rim attachment plate 14 shown in FIG. 2 includes a sliding plate 38, a spring 40, a release loop 48, and a release cable 50 which runs from the release loop 48 to the sliding plate 38. The sliding plate 38 forms a first rim engagement structure. On the first end 16 of the rim attachment plate 14, a first retaining groove 20 is formed by a bracket 52 which is attached to the rim attachment plate 14. The bracket 52 forms a second rim retaining structure. The bracket 52 could be a short section of material with the same curve as the inside of the basketball rim 12, or it could also be a short post or bar, tab, or outwardly facing hook which creates the first rim retaining groove. On the second end 18 of the rim attachment plate 14 the top side 44 of the rim attachment plate 14 overlaps the basketball rim 12. The sliding plate 38 is configured to slide into position under the basketball rim 12, for securing the rim attachment plate 14 to the basketball rim 12. The sliding plate 38 and is preferably connected to an arcuate wall 58, which forms the second retaining grove 22 and the second rim engaging structure. The sliding plate 38 is attached to a release loop 48 by a release cable 50. When the release loop 48 is pulled, the sliding plate 38 is moved backward from contact with the basketball rim 12, and in that position the rim attachment plate 14 may be lifted up from the basketball rim. The basketball rim is engaged and secured by the spring pressing against the basketball rim, and pressing both the first and second rim retaining grooves into engagement with the basketball rim.

It would be an obvious variation of the invention to have the rim attachment plate attached by different mechanical means to the basketball rim. For instance, a sliding plate 38 on each side of the rim attachment plate 14 could be utilized to securely attach the rim attachment plate to the basketball rim 12. Similarly, the sliding plate 38 could be configured to engage the top edge of the basketball rim with the rim attachment plate 14 being configured to engage the bottom edge of the basketball rim. This kind of variation would still remain within the scope of the invention. Also within the scope of the invention are optional mechanical linkages to the basketball rim, such as opposing posts, bars, or hooks which tighten again the basketball rim, and the use of more than two points of contact against the rim, although these optional constructions are not the preferred embodiment.

Shown in FIG. 2 is a threaded collar 54 into which a threaded end of the net standard 26 could be threaded, as an alternate form of attachment. The design could also be unitary in structure, with the net standard 26 attached to the rim attachment plate 14, or the net standard 26 could be removable from the collar or sleeve, and may pass through the rim attachment plate for adjustment. Shown in FIG. 2 is a cable guide 56, through which the release cable 50 passes.

Figure 3:
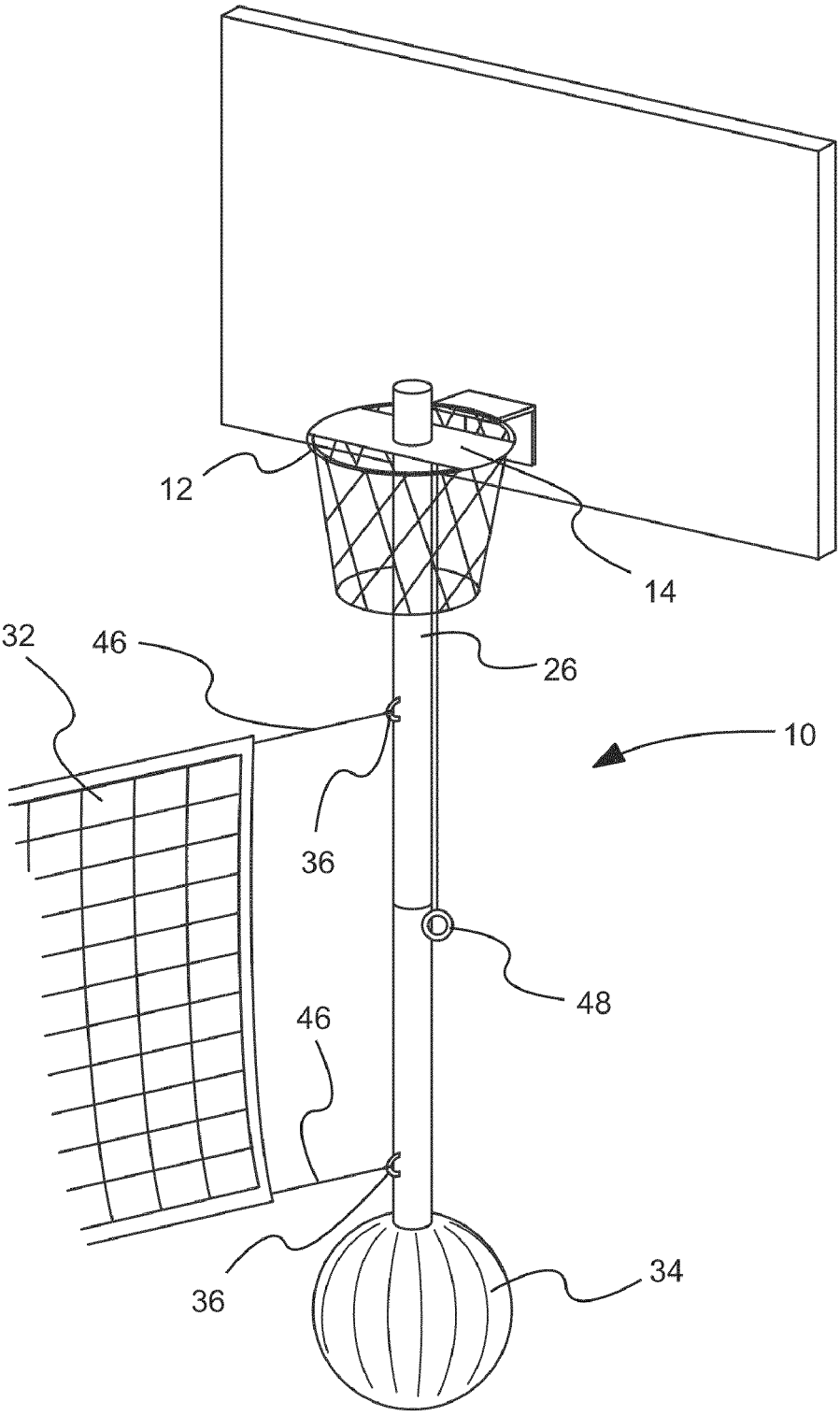
FIG. 3 is a perspective view of one version of the net standard assembly of the invention attached to a basketball rim.

Shown in a FIG. 3 is another view of a preferred version of the net standard assembly 10 of the invention attached to a basketball rim 12. It includes a rim attachment plate 14, with an attached net standard 26. The rim attachment plate is configured for attachment to a basketball rim 12. The net standard is available for attachment of a net 32. Shown in FIG. 3 is a net 32, which may be configured for volleyball, badminton, or other net sports. Shown attached to the net are tie ends 46 which are attached to the edge of the net and also to the net attachment loops 36. Although protruding loops are shown, the net standard can be attached by a number of means including straps which wrap around the net standard 26, holes in the net standard 26, or other conventional means of attachment.

The rim attachment plate 14 and the net standard 26 can be made from a number of different types of materials. For instance, the net standard 26, although generally tubular in construction, may be circular or square or otherwise in cross-section. The rim attachment plate 14 is preferably made of metallic material such as steel, but use of other materials such as aluminum or even plastic is also possible. Shown in FIG. 3 is a collision prevention structure 34 which in FIG. 3 is shown as a ball shaped structure 34. The collision prevention structure 34 can also take a number of shapes, such as drum shaped, rectangular, or other structures. Almost any shape of structure could work for this part of the device, because its purpose is to prevent players of the game from walking into the base of the net standard 26, and being injured. Shown in FIG. 3 is a release loop 48 which is attached to a sliding plate which is shown better in other Figures. As shown in FIG. 1, the net standard 26 may be made of two of more extendable sections, which function similarly to the extendable pole disclosed in U.S. Pat. No. 5,983,455.

Figure 4:
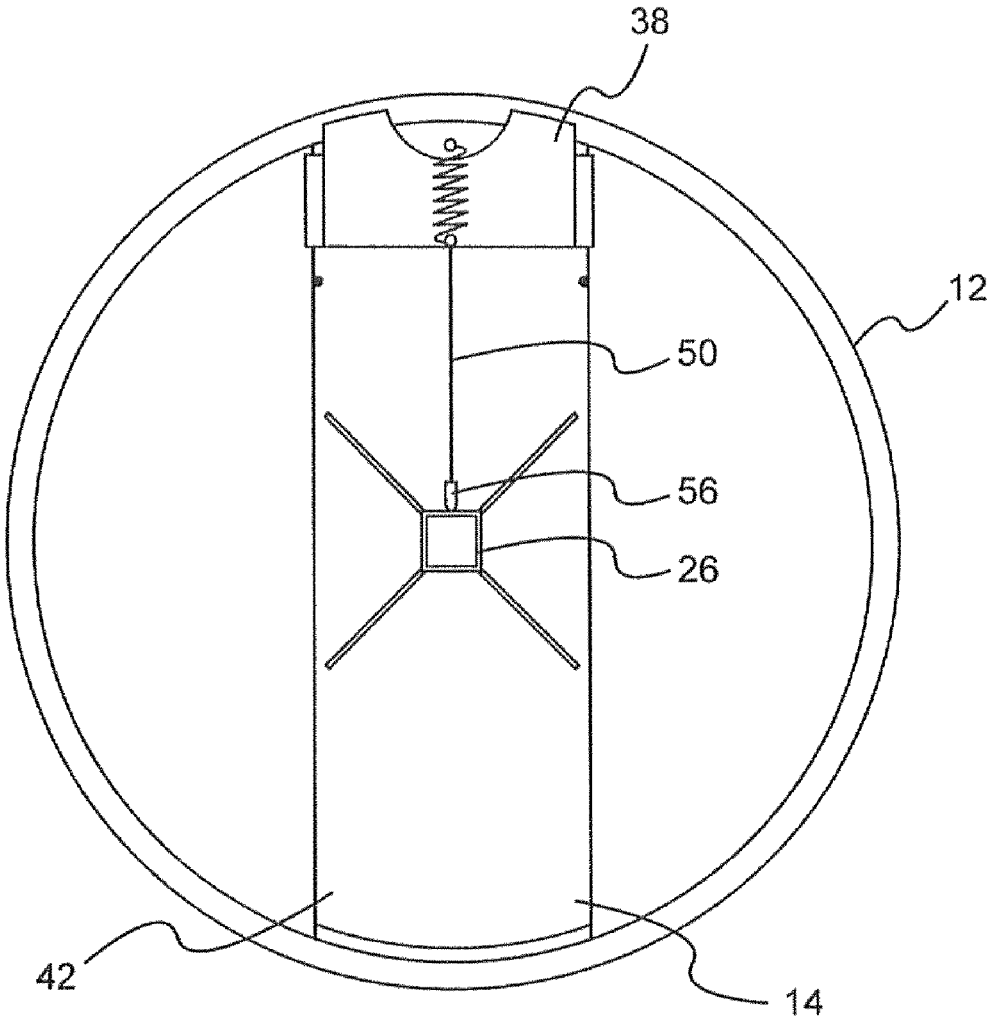
FIG. 4 is a view of the bottom side of the rim attachment plate attached to a basketball rim.

FIG. 4 shows a view of the one preferred embodiment's bottom side 42 of the rim attachment plate 14. In this version of the device, the net standard 26 is a square tubular structure. Also shown is sliding plate 38, release cable 50 and cable guide 56.

Figure 5:
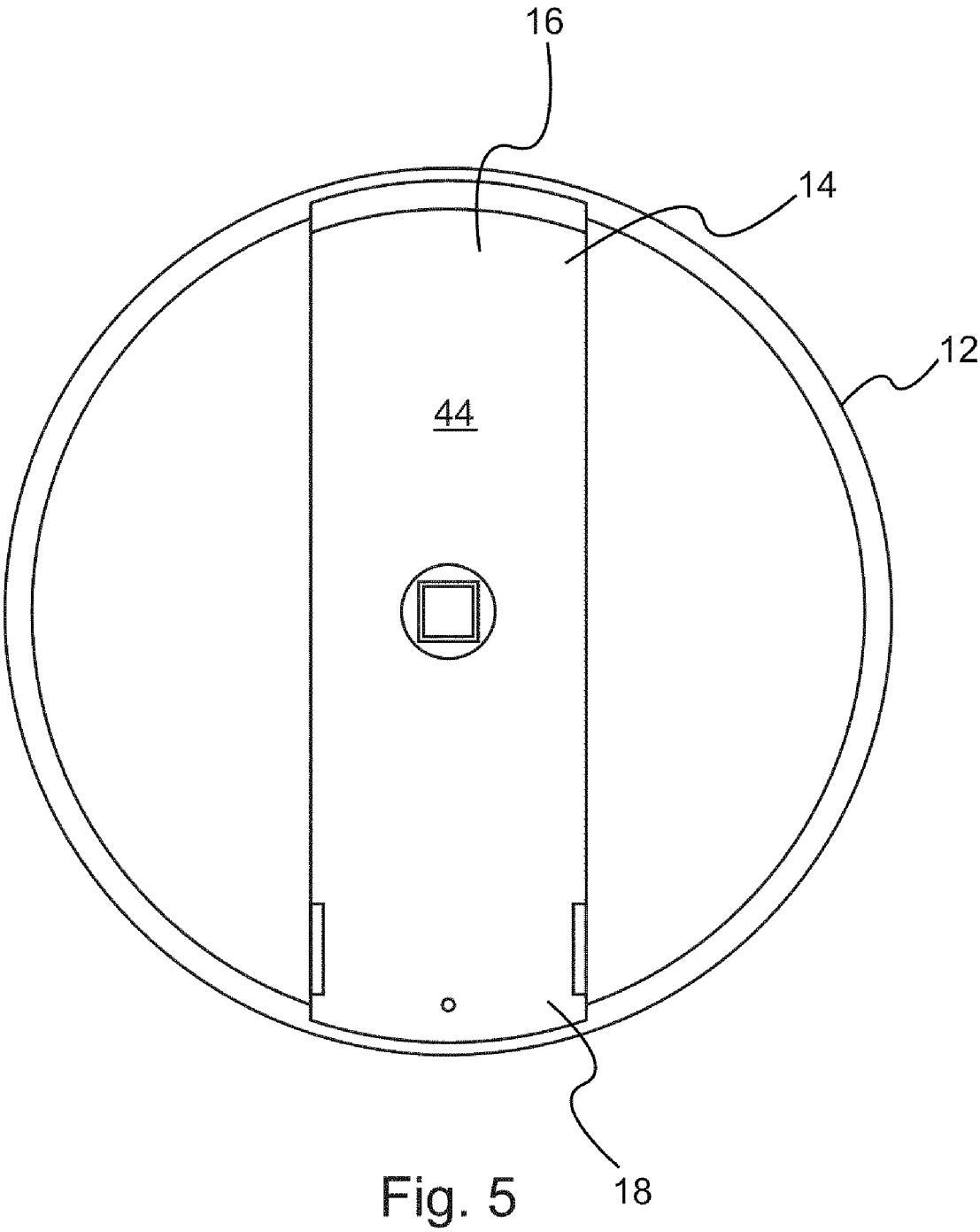
FIG. 5 is a view of the top side of the rim attachment plate attached to a basketball rim.

FIG. 5 is a view of the top side 44 of the rim attachment plate 14 and shows the first end 16 and the second end 18 of the rim attachment plate 14 overlapping the basketball rim 12.

FIG. 6 shows a preferred version of the net standard assembly. Shown is the bottom side 42 of the rim attachment plate 14, with a cam lock 96 which serves to lock the net standard 26 in the sleeve 80. A second retaining groove 22 is formed at the second end 18 of the rim attachment plate 14. A first rim retaining groove 20 is formed at the first end 16 of the rim attachment plate 14. Sliding plate 38 is moved back and forth from an open position to a locked position, by arm 98 and crank 100. The crank 100 is turned from below, such as by a socket or an Allen wrench. The sliding plate 38 moves inside a housing 102, but could also be guided by rails, grooves, or similar structures.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A net standard assembly for attachment to a basketball rim, for attachment of one end of a net for a net sport, comprising: a rim attachment plate with a top side and a bottom side, for attachment to said basketball rim, said rim attachment plate having at least a first and second rim engaging brackets, with said rim engaging brackets configured for engagement with generally opposite sides of said basketball rim; at least one rim clamp built into said rim attachment plate for securing said rim attachment plate to said basketball rim; and a net standard attached to said rim attachment plate, with said net standard having a first and a second end, and being a generally pole shaped structure configured to extend downward from said rim attachment plate when installed on a basketball rim, with said net standard configured for attachment of one end of a net for net sports.

2. The net standard assembly of claim 1 in which said net standard further includes net attachment loops on said net holding standard for attachment of ends of said net.

3. The net standard assembly of claim 2 which further comprises a collision prevention structure.

4. The net standard assembly of claim 3 in which said collision prevention structure is comprised of foam padding.

5. The net standard assembly of claim 4 which further comprises a sleeve attached to said rim attachment plate, with said sleeve surrounding said net standard, with said net standard adjustable in position in said sleeve.

6. The net standard assembly of claim 5 which further comprises a position clamp on said sleeve for securing said net standard at a selected height.

7. The net standard assembly of claim 4 in which said upper and lower brackets further comprise a first and a second bracket clamp for securing said first and second claim to said net standard.

8. A net standard assembly for attachment to a basketball rim, for attachment of one end of a net for a net sport, comprising: a rim attachment plate with a top side and a bottom side, for attachment to said basketball rim, said rim attachment plate having at least a first and second rim engaging brackets, with said rim engaging brackets configured for engagement with generally opposite sides of said basketball rim; at least one rim clamp built into said rim attachment plate for securing said rim attachment plate to said basketball rim; a net standard attached to said rim attachment plate, with said net standard having a first and a second end, and being a generally pole shaped structure configured to extend downward from said rim attachment plate when installed on a basketball rim, with said net standard configured for attachment of one end of a net for net sports; and at least one detachable net attachment bracket attached to said net standard and configured for attachment of said net, with said net utilizing the releasable attachment bracket coupled to said net standard, and configured to release from a pull normal to said net standard.

9. The net standard assembly of claim 8 in which said net attachment bracket is a releasable rod coupled to said net standard, configured for attachment of an end of said net.

10. The net standard assembly of claim 9 in which said releasable rod is coupled to said net standard by a top and a bottom bracket attached on net standard.

11. The net standard assembly of claim 10 in which said top and bottom brackets is adjustable in position on said net standard.

12. A net standard assembly for attachment to a basketball rim, for attachment of one end of a net for a net sport, comprising: a rim attachment plate with a top side and a bottom side, for attachment to said basketball rim, said rim attachment plate having at least a first and second rim engaging brackets, with said rim engaging brackets configured for engagement with generally opposite sides of said basketball rim; at least one rim clamp built into said rim attachment plate for securing said rim attachment plate to said basketball rim; a net standard attached to said rim attachment plate, with said net standard having a first and a second end, and being a generally pole shaped structure configured to extend downward from said rim attachment plate when installed on a basketball rim, with said net standard configured for attachment of one end of a net for net sports; and a detachable net attachment rod attached to said net standard by an upper and a lower bracket and configured for attachment of said net, with said net attachment rod configured to release from a pull normal to said net standard.

13. The net standard assembly of claim 12 in which said rim attachment plate has a left and a right side parallel to each other, and a first end and a second end, with said first and second rim engaging brackets positioned adjacent said first end and said ends.

14. The net standard assembly of claim 13 in which said rim engaging brackets comprise a first rim retaining groove and a second rim retaining groove configured for engagement with said basketball rim.

15. The net standard assembly of claim 12 which further comprises at least one arcuate rim engagement wall consistent with a curved basketball rim and attached to an underside of said rim attachment plate, for engagement with an interior side of curved basketball rim, said arcuate rim engagement wall for engagement with said basketball rim.

16. The net standard assembly of claim 15 which further comprises at least a first and a second arcuate rim engagement wall consistent with a curved basketball rim and attached to an underside of said rim attachment plate, for engagement with an interior side of curved basketball rim, said arcuate rim engagement walls for engagement with said basketball rim.

17. A net standard assembly for attachment to a basketball rim, for attachment of one end of a net for a net sport, comprising: a rim attachment plate with a top side and a bottom side, for attachment to said basketball rim, said rim attachment plate having at least a first and second rim engaging brackets, with said rim engaging brackets configured for engagement with generally opposite sides of said basketball rim; at least one rim clamp built into said rim attachment plate for securing said rim attachment plate to said basketball rim; a net standard attached to said rim attachment plate, with said net standard having a first and a second end, and being a generally pole shaped structure configured to extend downward from said rim attachment plate when installed on a basketball rim, with said net standard configured for attachment of one end of a net for net sports; a sleeve attached to said rim attachment plate, with said sleeve surrounding said net standard, with said net standard adjustable in position in said sleeve, with a net standard position clamp on said sleeve for securing said net standard at a selected height; and a detachable net attachment rod attached to said net standard by an upper and a lower bracket and configured for attachment of said net, with said net attachment rod configured to release from a pull normal to said net standard.

18. The net standard assembly of claim 17 in which said rim attachment plate has a left and a right side parallel to each other, and a first end and a second end, with said first and second rim engaging brackets positioned adjacent said first end and said ends.

19. The net standard assembly of claim 17 in which said rim engaging bracket further comprises at least one arcuate rim engagement wall consistent with a curved basketball rim and attached to an underside of said rim attachment plate, for engagement with an interior side of curved basketball rim, said arcuate rim engagement wall for engagement with said basketball rim.

20. The net standard assembly of claim 17 which further comprises at least a first and a second arcuate rim engagement wall consistent with a curved basketball rim and attached to an underside of said rim attachment plate, for engagement with an interior side of curved basketball rim, said arcuate rim engagement walls for engagement with said basketball rim.

21. The net standard assembly of claim 17 in which said rim engaging structures comprise a first rim retaining groove and a second rim retaining groove configured for engagement with said basketball rim.

22. The net standard assembly of claim 17 which further comprises a collision prevention structure.

23. The net standard assembly of claim 22 in which said collision prevention structure is comprised of foam padding.

24. The net standard assembly of claim 17 in which said net standard is detachable from said rim attachment plate.

25. The net standard assembly of claim 17 in which said rim clamp comprises a sliding plate with a spring, with said spring pulling said sliding plate toward an end of said rim attachment plate, and with said sliding plate configured to engage said basketball rim.

26. The net standard assembly of claim 17 in which said rim clamp comprises an expanding bracket that moves toward an end of said rim attachment plate sliding plate by use of a rotatable adjustment.

27. The net standard assembly of claim 26 which further comprises a detachable lever adjustment rod, with said lever adjustment rod removably attached to a part of said net standard assembly.

28. The net standard assembly of claim 17 in which said rim clamp is secured by a tensioning lever.

29. The net standard assembly of claim 17 in which said net standard is configured to be extendable to engage a floor of a playing area, for stabilization of said net standard.

* * * * *